US006863552B1

(12) United States Patent
Katwala et al.

(10) Patent No.: US 6,863,552 B1
(45) Date of Patent: Mar. 8, 2005

(54) ELECTRICAL CONNECTOR WITH METAL COUPLING SLEEVE

(75) Inventors: Rajiv D. Katwala, Milford, CT (US); Patrick J. Tiberio, Huntington, CT (US)

(73) Assignee: Hubbell Incorporated, Orange, CT (US)

( * ) Notice: Subject to any disclaimer, the term of this patent is extended or adjusted under 35 U.S.C. 154(b) by 0 days.

(21) Appl. No.: 10/738,982

(22) Filed: Dec. 19, 2003

(51) Int. Cl.[7] ..... H01R 4/38
(52) U.S. Cl. ..... 439/320
(58) Field of Search ..... 439/320, 321, 439/322, 323, 313

(56) References Cited

U.S. PATENT DOCUMENTS

| | | | | |
|---|---|---|---|---|
| 1,195,433 A | | 8/1916 | Bailey | |
| 3,039,072 A | | 6/1962 | Robinson et al. | |
| 3,049,690 A | | 8/1962 | Sparber | |
| 3,393,927 A | | 7/1968 | Kelly et al. | |
| 3,576,517 A | * | 4/1971 | Johnson et al. | 439/274 |
| 3,596,936 A | | 8/1971 | Dieckmann et al. | |
| 3,601,764 A | | 8/1971 | Cameron | |
| 3,808,580 A | | 4/1974 | Johnson | |
| 3,971,614 A | | 7/1976 | Paoli et al. | |
| 4,531,801 A | * | 7/1985 | Baur | 439/313 |
| 4,550,966 A | | 11/1985 | Riley | |
| 4,647,127 A | | 3/1987 | Weingartner | |
| 4,708,370 A | | 11/1987 | Todd | |
| 4,938,718 A | * | 7/1990 | Guendel | 439/680 |
| 5,021,001 A | | 6/1991 | Ramirez | |
| 5,035,640 A | * | 7/1991 | Drogo | 439/321 |
| 5,188,399 A | | 2/1993 | Durina | |
| 5,192,219 A | | 3/1993 | Fowler et al. | |
| 5,641,310 A | | 6/1997 | Tiberio, Jr. | |
| 6,102,444 A | | 8/2000 | Kozey | |
| 2003/0193193 A1 | | 10/2003 | Harrington et al. | |

FOREIGN PATENT DOCUMENTS

| | | |
|---|---|---|
| FR | 606163 | 6/1926 |

* cited by examiner

*Primary Examiner*—Thanh-Tam Le
(74) *Attorney, Agent, or Firm*—Mark S. Bicks; Garrett V. Davis; Alfred N. Goodman

(57) ABSTRACT

An electrical assembly is constructed for mounting to an electrical box or other support surface. The electrical assembly includes a non-metallic body that supports an electrical device such as an electrical receptacle that is surrounded by a non-metallic collar. A metal sleeve surrounds the collar such that the sleeve is electrically insulated from the electrical device by the collar. The sleeve includes a coupling member such as external threads for mating with complementing threads of a mating electrical device to provide a secure coupling to obtain a watertight rating.

47 Claims, 5 Drawing Sheets

72
88
106
116
52
98
86
12
24
108
30
16
18
34
50
36
72
52
98
94
22

ELECTRICAL CONNECTOR WITH METAL COUPLING SLEEVE

FIELD OF THE INVENTION

The present invention is directed to an electrical assembly and particularly an electrical connector having a coupling device for connecting the assembly to another electrical assembly or device. The invention is particularly directed to an electrical assembly having a non-metallic body and a metallic coupling member for coupling the assembly to another electrical assembly.

BACKGROUND OF THE INVENTION

Electrical connectors having a locking or coupling member for coupling the electrical connector to a complementary electrical connector are known in the art. The electrical connectors generally have a housing supporting electrical wires and having suitable electrical contacts. The body of the electrical connector is designed to mate with another electrical connector such that the electrical contacts of the respective electrical connector provide a continuous electrical connection. The coupling members on the electrical connectors couple the electrical connectors together to prevent separation during use. A number of connector assemblies using male and female connectors have been developed to prevent accidental separation of the connectors. In one type of assembly includes a female connector has two or more arcuate circularly arranged or cylindrical openings, while the male connector has an equal number of pins or blades that can be inserted into the slots.

One example of an electrical connector having a locking member is disclosed in U.S. Pat. No. 3,808,580 to Johnson. The electrical connector disclosed in this patent includes a cylindrical housing supporting an electrical connector and having a sleeve rotatably mounted on the housing. The sleeve includes internal threads and encircles the housing. A second electrical connector includes a housing with an electrical contact for mating with the electrical contact of the first connector. The second connector includes a collar surrounding the electrical contact and having external threads for mating with the internal threads of the rotatable sleeve of the first connector. The electrical connectors are joined together and the threaded sleeves are coupled to form a secure connection.

Another example of an electrical connector is disclosed in U.S. Pat. No. 3,971,614 to Paoli et al. The electrical connector includes a first housing with a cylindrical sleeve having external threads. A second connector includes a sleeve with internal threads for mating with the external threads of the first connector. The sleeve of the second connector is rotatably mounted thereon for coupling the electrical connectors together.

Other electrical devices having a threaded end for connecting with threads of a complementing electrical device are known. One such electrical device is an electrical receptacle having a housing that can be mounted to an electrical box or other support. The electrical device can have a threaded end for mating with the threaded end of another electrical device to be connected thereto. These devices are often made of metal to provide sufficient strength to the electrical device for industrial use. A disadvantage of metal devices is the potential failure of the electrical insulation of the wiring contained therein and the resulting risk of injury to the user. Other devices are made of a plastic material which reduce the risk of electrical shock or injury to the user.

Accordingly, there is a continuing need in the industry for improved electrical devices.

SUMMARY OF THE INVENTION

The present invention is directed to an electrical connector assembly and to a locking arrangement for locking together a pair of mating electrical connectors. The invention is particularly directed to an electrical connector assembly having a threaded coupling member for coupling the assembly to another mating electrical assembly.

Accordingly, a primary aspect of the invention is to provide an electrical assembly having a removable and replaceable coupling member for coupling the assembly to an adjacent electrical assembly.

Another aspect of the invention is to provide an electrical assembly having a body portion made of an electrically insulating material and a metallic coupling member for coupling with an adjacent electrical assembly. The metallic coupling member is preferably electrically insulated from an inner cavity of the body portion.

A further aspect of the invention is to provide an electrical assembly having a body portion that can be mounted to an electrical box or other support. The body portion is made of a plastic material and includes a metallic coupling member for connecting the assembly to an adjacent electrical assembly.

Still another aspect of the invention is to provide an electrical assembly that can be easily connected and disconnected from a mating electrical assembly.

A further aspect of the invention is to provide an electrical assembly having a coupling member that is sufficiently strong to prevent inadvertent disconnection from a mating electrical assembly and to prevent accidental damage when not in use.

Another aspect of the invention is to provide an electrical assembly having a body made from an electrically insulating material and a metallic coupling member where the metallic coupling member is electrically insulated from electrical wiring or electrical components contained within the body. The metallic coupling member surrounds an access opening in the body. In one embodiment, the metallic coupling member is secured to the body but can be removed and replaced in the event the coupled member is damaged or otherwise rendered inoperable.

A further aspect of the invention is to provide an electrical assembly such as an electrical receptacle having a body made from an electrically insulating material and having a collar extending from the body allowing access to the electrical device supported within the body. In one embodiment, the collar surrounds the electrical device to support and electrically insulate the electrical device from the environment. A metallic sleeve is coupled to the body surrounding the collar such that the metallic sleeve is electrically insulated from the electrical device and electrical wires contained within the body. The metallic sleeve includes a coupling member for coupling with another electrical assembly. In one embodiment, the metallic sleeve includes external threads for mating with a threaded collar on a mating electrical assembly.

The various aspects and advantages of the invention are basically attained by providing an electrical connector assembly which comprises a body having an internal cavity for receiving a first electrical device, and an opening for allowing access to the first electrical device. The body is made from an electrically insulating material. A metallic sleeve is coupled to the body and surrounds at least a portion of the body so that the metallic sleeve is electrically insulated from the first electrical device and surrounds the opening in the body. The metallic sleeve has a coupling member for removably coupling to a second electrical connector.

The advantages of the invention are further attained by providing an electrical connector assembly which comprises a hollow body having an open outer end. The body has an internal cavity supporting an electrical wiring device. The electrical wiring device has a coupling end positioned at an outer distal end of a collar. The body is made of an electrically insulating material. A metallic sleeve surrounds at least a portion of the body and is coupled to the body. The sleeve has a cylindrical outer surface with coupling threads for mating with a threaded coupling. The sleeve is electrically insulated from the electrical wiring device by the collar.

The advantages and aspects of the invention are also attained by providing an electrical assembly which comprises a body made from an electrically insulating material. The body has a housing and a substantially cylindrical collar extending from the housing. The body also has an internal cavity. A first electrical wiring device is mounted in the body and has a coupling end aligned with the collar where the coupling end is accessible through the collar. A metallic sleeve has an inner dimension complementing an outer dimension of the collar. The collar has an outer surface with a coupling member. The sleeve is coupled to the body and surrounds the collar. A second electrical wiring device is separably coupled to the first electrical wiring device through the collar and has a coupling member separably coupled to the coupling member of the sleeve.

The various aspects, advantages and salient features of the invention will become apparent from the following detailed description which, in conjunction with the annexed drawings, disclose preferred embodiments of the invention.

BRIEF DESCRIPTION OF THE DRAWINGS

The following is a brief description of the invention, in which.

DETAILED DESCRIPTION OF THE INVENTION

The present invention is directed to an electrical assembly 10 and particularly to an electrical connector where the assembly includes a body 12 and a sleeve 14. In the illustrated embodiments, assembly 10 is constructed to contain electrical wiring and one or more electrical devices.

Figure 1:
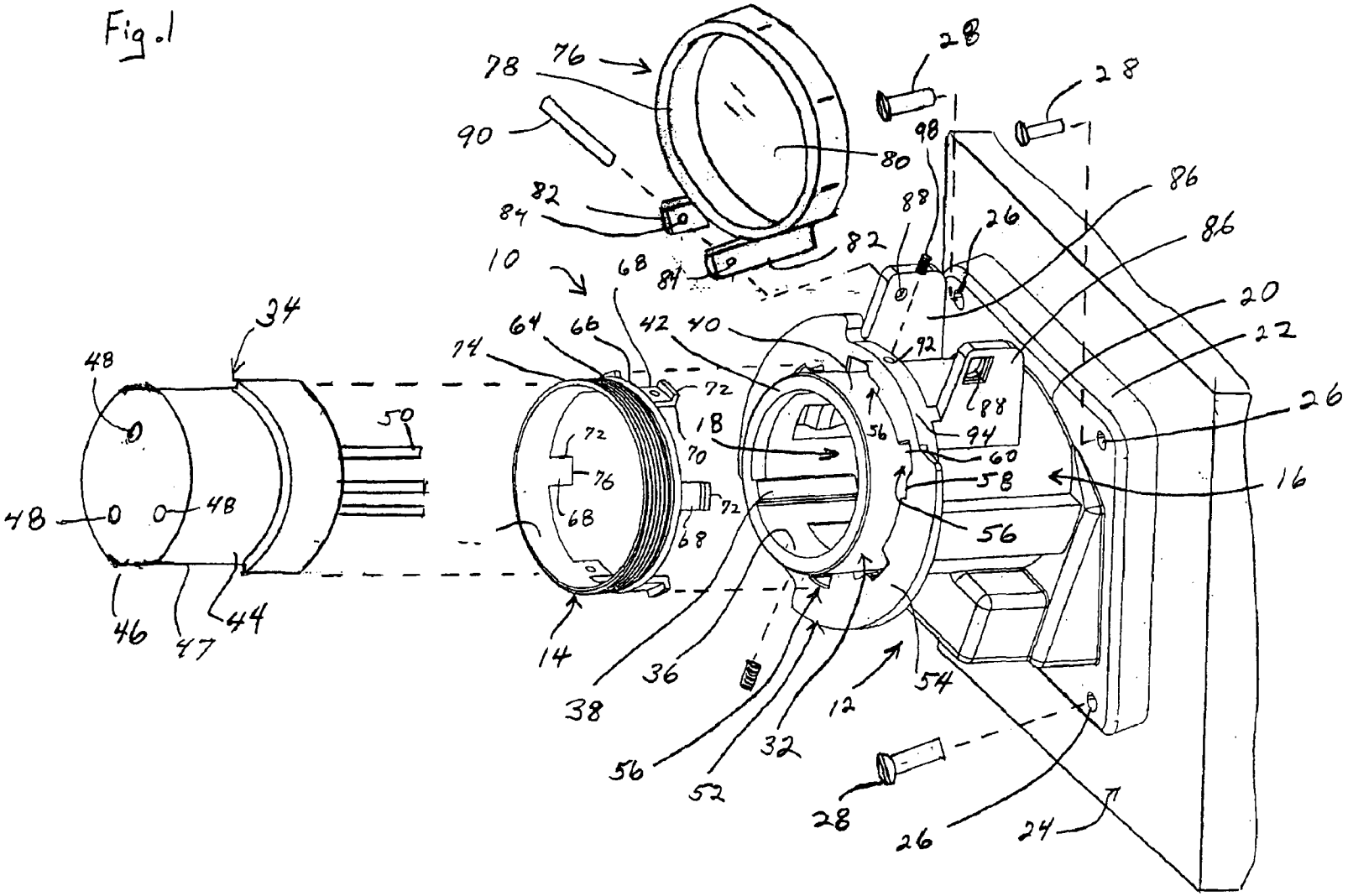
FIG. 1 is an exploded perspective view of the invention showing the housing and sleeve of the electrical connector assembly in one embodiment of the invention.
Figure 2:
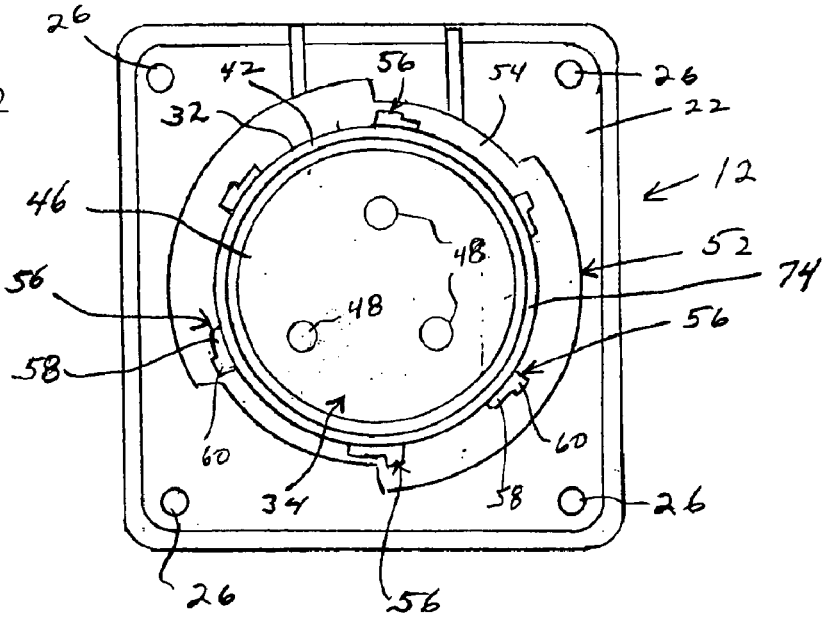
FIG. 2 is a front view of the housing of the assembly of FIG. 1 without the sleeve and with the cover for the assembly removed.

Referring to FIG. 1, assembly 10 includes a housing 16 having an internal cavity 18. In one embodiment, cavity 18 defines an axial through passage to allow electrical wiring to pass through housing 16. In other embodiments, housing 16 can have a closed bottom wall with knock-out plugs which can be removed to allow access to cavity 18. As shown in FIG. 1, housing 16 has a proximal end 20 connected to a base 22. Preferably, housing 16 is integrally formed with base 22 to form a unitary structure. Base 22 defines a substantially flat surface for mounting to an electrical box 24 as shown or other support structure. Base 22 preferably includes an arrangement so that the base can be securely mounted to a support structure. In the illustrated embodiment, the base has a plurality of apertures 26 to receive screws 28 for coupling base 22 to electrical box 24.

As shown in FIG. 1, housing 16 has a longitudinal axis that is oriented at an incline with respect to the plane of base 22 such that housing 16 extends from base 22 at an incline. In alternative embodiments, housing 16 can extend from base 22 in a direction substantially perpendicular to the plane of base 22.

Figure 5:
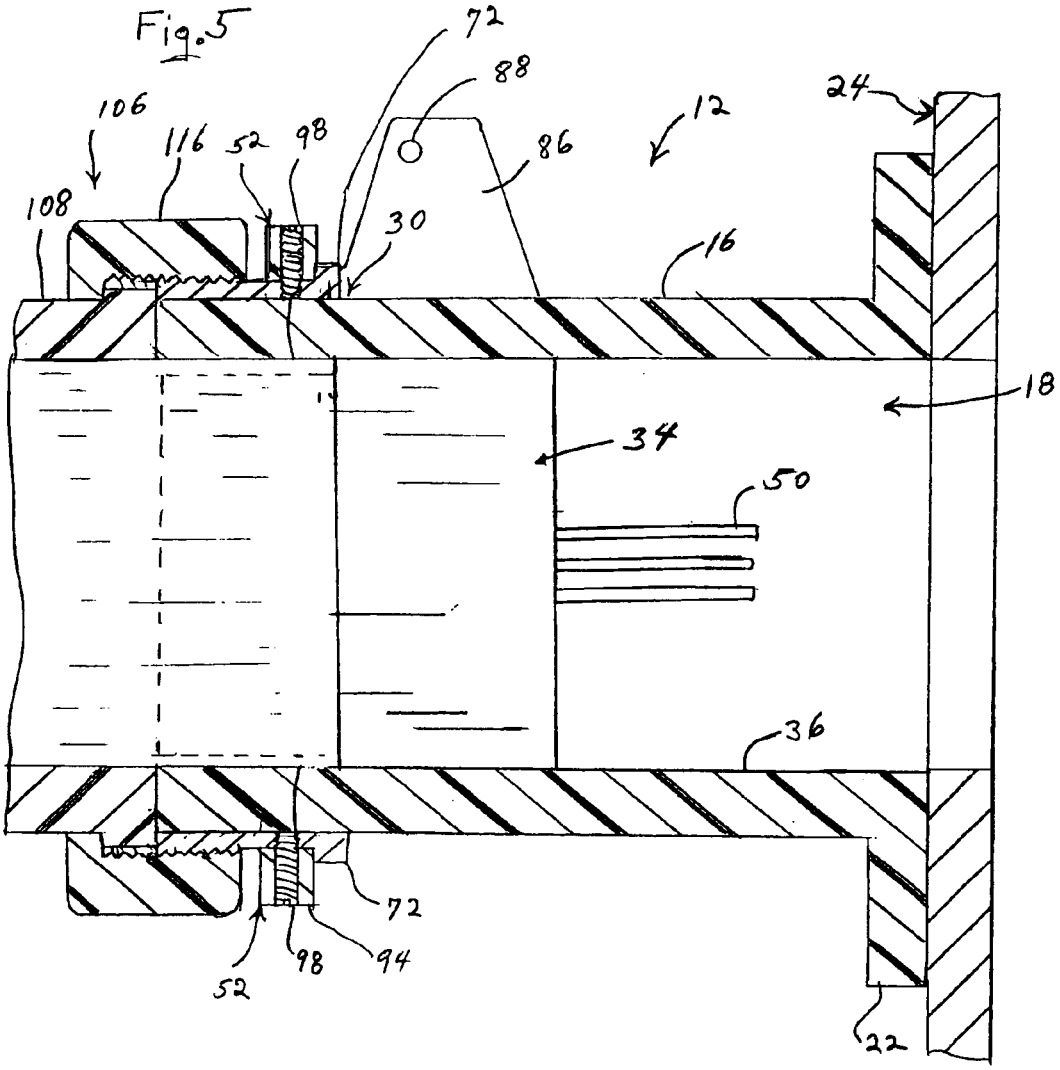
FIG. 5 is a side view in cross section of the electrical connector assembly taken along line 5—5 of FIG. 2.
Figure 6:
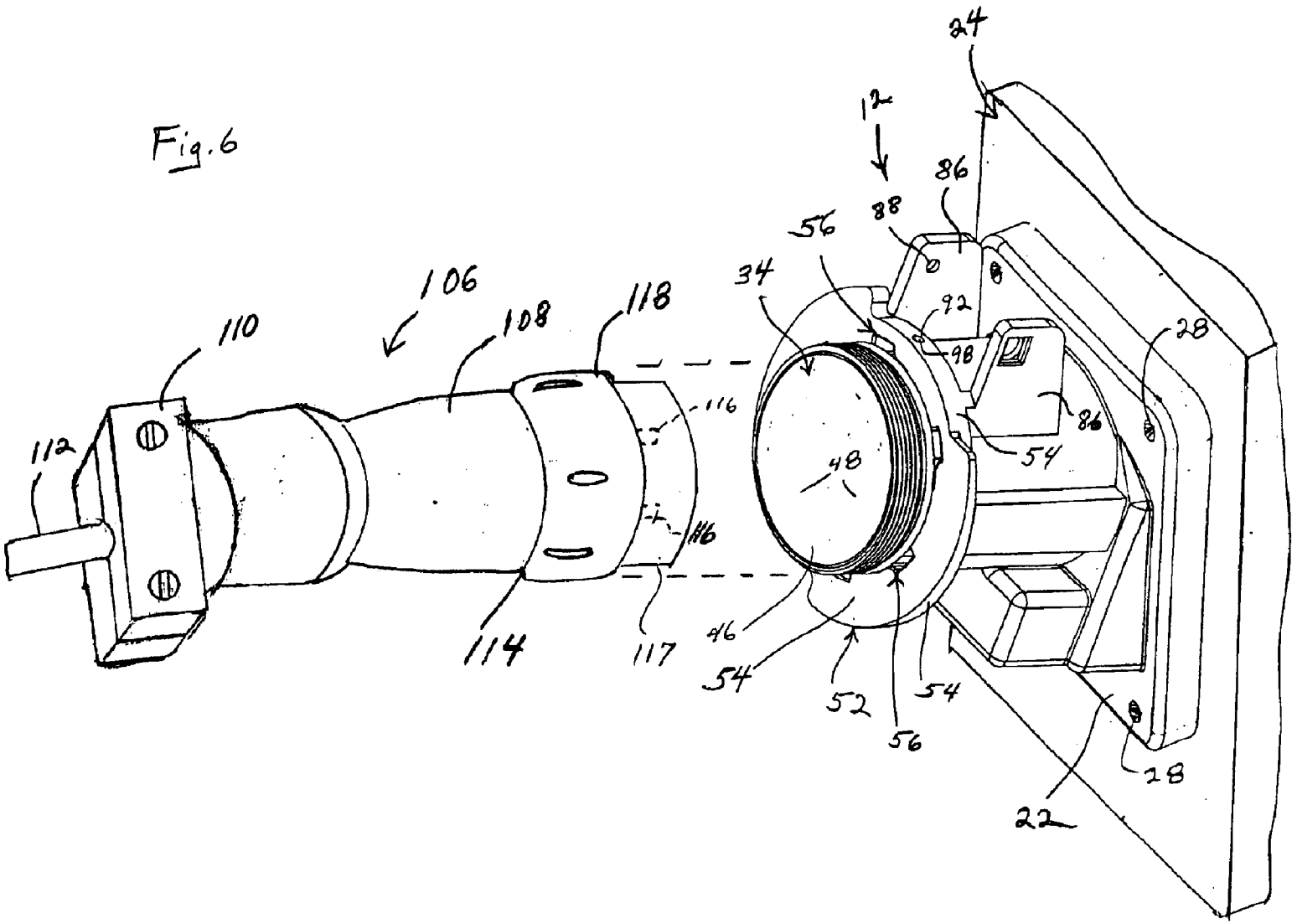
FIG. 6 is a perspective view of the electrical assembly showing the electrical connector assembly connecting with a mating electrical assembly.

Referring to FIG. 5, housing 16 includes a distal end portion 30 that defines an end portion that receives and supports sleeve 14. In one preferred embodiment, the end portion is in the form of a collar 32. In the illustrated embodiment, collar 32 is essentially an extension of and continuous with housing 16. Collar 32 has an axial passage that is continuous with cavity 18 of housing 16. Collar 32 has an inner dimension that is sufficient to receive and support an electrical device 34, electrical wiring and the like. In the embodiment illustrated, collar 32 has a substantially cylindrical inner face 36 for receiving electrical device 34 where electrical device 34 has a complementary outer shape and dimension. A longitudinal rib 38 is provided to mate with a corresponding groove in electrical device 34 to orient electrical device 34 in a selected angular orientation within collar 32. In other embodiments, collar 32 can have a square, rectangular or other shaped passage depending on the shape of the electrical device being positioned within the passage of collar 32.

In preferred embodiments of the invention, collar 32 is integrally formed with housing 16 to define body 12 as a single unitary structure. Preferably, body 12 is made from an electrically insulating material, such as a plastic resin as commonly used in the construction of electrical devices. Body 12 is typically formed by standard injection molding techniques as known in the art.

Collar 32 is constructed to be connected to sleeve 14 in a secure manner and where sleeve 14 can be removed if necessary. Collar 32 in a preferred embodiment has a cylindrical outer surface 40 and an axial face 42. In preferred embodiments, electrical device 34 is fitted within collar 32 so that electrical device 34 is accessible through the passage of collar 32. Electrical device 34 in the embodiment illustrated is an electrical receptacle having a body 44 with a coupling end at an outer face 46. In the illustrated embodiment, outer face 46 includes a plurality of apertures 48 which can be circular openings or slots providing access to electrical contacts supported within body 44. Electrical wires 50 extend from one end of body 44 which are connected to a suitable power source (not shown). It is to be understood that the structure of electrical device 34 as shown is intended to be exemplary of a suitable connector. The connector can have other suitable structures as known in the art. For example, the connector can have annular shaped contacts and various numbers of contacts depending on the intended use of the connector. In one preferred embodiment, collar 32 has an open end receiving electrical device 34 such that the outer face 46 of electrical device 34 is aligned with axial face 42 of collar 32 as shown in FIG. 5. Electrical device 34 includes an outer surface with a recessed portion 47. In alternative embodiments, collar 32 can include an end wall to close the outer end of collar 32 where the end wall is provided with appropriate apertures or other openings to allow access to electrical device 34.

Housing 16 is provided with a flange 52 positioned at the base of collar 32 and at distal end 30 of the housing 16. As shown in FIG. 1, flange 52 extends radially outward and lies in a plane substantially perpendicular to a longitudinal axis of collar 32 and housing 16. Flange 52 has a substantially annular shape encircling collar 32 and includes a substantially planar axial surface 54 that faces away from base 22. Flange 52 includes a plurality of openings in the form of slots 56 uniformly spaced around the perimeter of flange 52. In the embodiment illustrated, slots 56 have an arcuate shape and are positioned adjacent collar 32 and extend circumferentially around collar 32. Each of slots 56 have a generally keyhole-like shape with a narrow arcuate section 58 and a larger second section 60.

Figure 3:
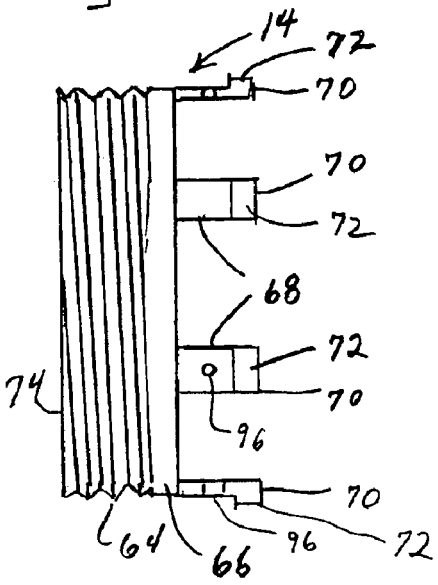
FIG. 3 is a side elevational view of the sleeve in the embodiment of FIG. 1.
Figure 4:
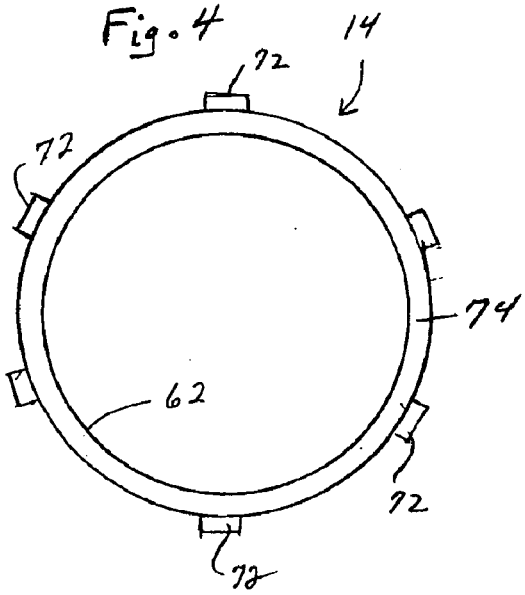
FIG. 4 is an end view of the sleeve of FIG. 3.

Sleeve 14 has a cylindrical shape with an axial length corresponding substantially to the axial length of collar 32. Preferably, sleeve 14 has a cylindrical inner surface 62 with an inner dimension corresponding to an outer dimension of collar 32 so that sleeve 14 can slide over collar 32. Sleeve 14 is constructed with a coupling member so that sleeve 14 can be used to connect a mating electrical assembly in a locking relation. In the embodiment illustrated, sleeve 14 is provided with external threads 64 that form a coupling member as discussed hereinafter in greater detail. Sleeve 14 has a base 66 and a plurality of legs 68 extending axially from base 66 as shown in FIGS. 1, 3 and 4. Legs 68 are uniformly spaced around the perimeter of sleeve 14 to complement the spacing of slots 56 in flange 52.

Preferably, the number of legs 68 on sleeve 14 correspond to the number of slots 56 in flange although the number of legs can be less than the number of slots. Typically, at least four legs are provided to provide sufficient strength and resist rotation of sleeve 14 during use. In the illustrated embodiment, six legs are provided to stabilize the sleeve. Legs 68 have an axial end 70 with a lug portion 72 so that the legs have a substantially L-shape. In one embodiment, lug portion 72 extends radially outward from legs 68 with respect to the axis of sleeve 14. Legs 68 have a width and thickness corresponding substantially to the dimensions of narrow section 58 of slot 56. Lug portion 72 has a dimension corresponding substantially to the larger section 60 of slot 66 whereby the lug portions 72 can pass through larger section 60 of slot 56 and engage the rear face of flange 52 when legs 68 are rotated to position legs 68 in narrow section 58 of slot 56. Sleeve 14 is assembled onto collar 32 by sliding sleeve 14 axially to insert legs 68 through a respective slot 56 and rotating sleeve 14 to lock sleeve 14 in place.

In other embodiments, slots 56 can have a slightly arcuate shape with a uniform width. In this embodiment, legs 68 have a tab extending in the plane of the leg to form a substantially L-shape. The legs can then be inserted through the slots and the sleeve rotated to lock the sleeve in place.

Sleeve 14 has an axial length corresponding to the length of collar 32 so that when base 60 seats against flange 52, the axial end 74 of sleeve 14 is aligned with the axial face 42 of collar 32. In preferred embodiments of the invention, sleeve 14 is made from a metal such as aluminum, although other rigid materials can be used. Sleeve 14 is preferably made of metal so that threads 64 have sufficient strength for coupling with a connector and can resist damage by impact. Preferably, sleeve 14 is assembled onto collar 32 in a manner so that sleeve 14 is electrically insulated by collar 32 from the inner cavity 18 of housing 14 and electrical device 34 supported therein.

In one embodiment of the invention, body 12 includes a cover 76 for covering the open end of electrical device 34. As shown in FIG. 1, cover 76 has a substantially cylindrical side wall 78 and an end wall 80. Arms 82 having apertures 84 extend from side wall 76 for forming hinge members. Housing 16 of body 12 has two spaced apart flanges 86 extending parallel to the longitudinal axis of housing 16. Flanges 86 include apertures 88 for receiving a pin 90 or other coupling member. Flanges 86 are spaced apart a distance corresponding to arms 82 whereby cover 76 can be coupled to flanges 86 to enable cover 76 to pivot from a closed position covering the axial end of electrical device 34 to an open position shown in FIGS. 7 and 8 allowing access to electrical device 34.

Sleeve 14 is coupled to body 12 by sliding sleeve 14 axially over collar 32 and inserting leg 68 of sleeve 14 through the larger section 60 of slots 56. Sleeve 14 is then rotated to position leg 68 in the narrow section 58 of slots 56, whereby sleeve 14 is locked to prevent separation in an axial direction. Preferably, a suitable locking member is provided to fix the position of sleeve 14 with respect to collar 34. In one embodiment, flange 52 includes one or more apertures 92 extending radially through flange 52 through an outer radial face 54. Apertures 92 are aligned with a narrow section 58 of a respective slot 56 to receive a suitable locking member. In one preferred embodiment, at least two legs 68 are provided with a tapped, threaded aperture 96 for receiving a screw 98. Sleeve 14 is assembled onto collar 32 and screw 98 is passed through aperture 92 and screwed into aperture 96 in leg 68 to secure sleeve 14 in place and prevent rotation of sleeve 14 and movement of legs 68 within the respective slot 56. In another embodiment, apertures 92 can include internal threads for receiving a screw. The screw is threaded into the aperture to engage the respective leg 68 of sleeve 14 to clamp leg 68 in place and prevent rotation and disassembly of sleeve 14 from collar 32.

Typically, sleeve 14 is positioned on collar 32 and secured in place by screw 98 although other securing devices can be used. In the event any portion of sleeve 14 is damaged, screw 98 can be loosened and/or removed, thereby allowing sleeve 14 to be rotated to release lug portion 72 from flange 52 whereby sleeve 14 can be removed. In this manner, sleeve 14 can be replaced when the sleeve is damaged or otherwise interferes with the desired operation of assembly 10.

In the embodiment illustrated, electrical assembly 10 is used in conjunction with electrical box 24 to supply appropriate electrical wiring to electrical device 34. In the embodiment illustrated in FIG. 7, electrical box 24 includes a primary switch handle 100 and a door 102 coupled to electrical box 24 by hinges 104.

Figure 7:
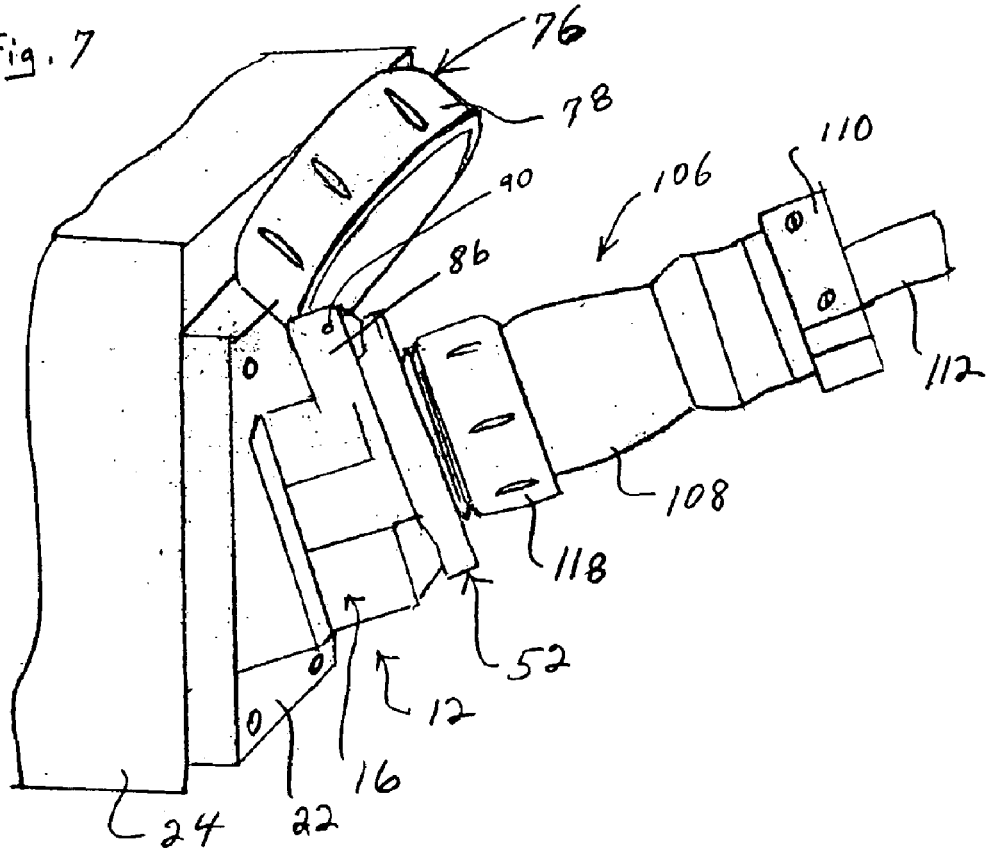
FIG. 7 is a perspective view of the electrical connector assembly of FIG. 1 showing the housing mounted to an electrical box and connected to a mating electrical assembly.
Figure 8:
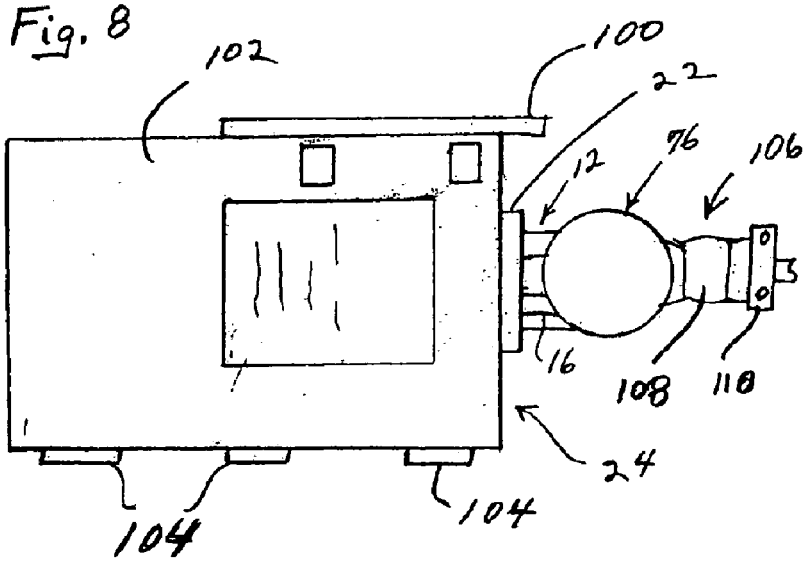
FIG. 8 is a top view of the electrical assembly of FIG. 7.

In the illustrated embodiment, electrical device 34 of electrical assembly 10 is an electrical receptacle for coupling with a complementing plug 106 or other mating electrical device. Plug 106 includes a body 108 having a clamp assembly 110 for securing an electrical cord 112. The outer end 114 of body 108 includes electrical prongs 116 that are positioned to mate with the apertures 48 of electrical device 34 and a sleeve 117. A collar 118 is coupled to outer end 114 of body 108 and is rotatably mounted thereon. Collar 118 includes internal threads 120 and has an inner diameter corresponding to an outer diameter of sleeve 14. In use, prongs 116 of plug 106 are inserted into apertures 48 of electrical device 34 and collar 118 is threaded onto sleeve 14 to couple plug 106 to electrical assembly 110 as shown in FIGS. 7 and 8. Preferably, electrical assembly 10 is able to form a weather tight seal when coupled to a mating electrical device. Electrical assembly 10 or plug 106 can form a seal between the mating components or include a suitable gasket material to prevent water or moisture from entering the space between the mating connectors.

In the illustrated embodiment, the electrical connector assembly includes a body that is mounted or secured to a stable surface. In other embodiments the electrical connector assembly can be electrical connectors that are coupled to a respective electrical cord. Preferably, the assembly includes a male and female connector such as that disclosed in U.S. Pat. No. 5,641,310 to Tibero which is hereby incorporated by reference in its entity. In the present invention, one of the connectors has a non-metallic body with a metal coupling sleeve that is electrically insulated from the wiring and electrical device contained in the connector body. The mating connector preferably includes a collar or other coupling member that is able to be coupled to the metal sleeve.

While various embodiments of the invention have been illustrated and described herein, it will be appreciated by those skilled in the art that various changes and modifications can be made to the invention without departing from the spirit and scope of the invention as defined in the appended claims.

What is claimed is:

1. An electrical connector assembly comprising:

a body having an internal cavity with a dimension for receiving a first electrical device, and an opening for allowing access to said first electrical device positioned in said internal cavity, and where said body is made from an electrically insulating material; and a metal sleeve coupled to said body to resist rotation of said metal sleeve with respect to said body and surrounding at least a portion of said body whereby said metal sleeve is electrically insulated from said first electrical device by said body and surrounds said opening in said body, said metal sleeve having a coupling member for removably coupling to a second mating electrical connector.

2. The assembly of claim 1, wherein said body includes a housing and a collar extending from said housing where said collar surrounds said first electrical device and where said sleeve has a substantially cylindrical shape with open axial ends and an inner dimension complementing an outer dimension of said collar.

3. The assembly of claim 2, wherein said collar has a substantially cylindrical outer surface, and said sleeve has a substantially cylindrical inner surface.

4. The assembly of claim 2, wherein said sleeve has a base portion with at least one leg extending axially therefrom and coupled to said body.

5. The assembly of claim 4, wherein said body includes at least one opening for mating with said at least one leg on said sleeve.

6. The assembly of claim 5, wherein said at least one leg has an outer end with a lug having a dimension complementing said at least one opening in said body for mating with said opening.

7. The assembly of claim 6, wherein said body has a flange extending radially outward and where said at least one opening is formed in said flange and has a substantially keyhole shape.

8. The assembly of claim 1, wherein said body has a base with an access opening into said housing, said base having a coupling member for coupling said base to a support structure.

9. The assembly of claim 8, wherein said coupling member in said base comprises a plurality of screw-receiving holes.

10. The assembly of claim 1, wherein said sleeve includes a plurality of legs extending from a base of said sleeve, each of said legs having a lug extending therefrom, and where said body includes a plurality of openings complementing said legs, said sleeve being coupled to said body by inserting said legs through a respective opening and rotating said sleeve with respect to said body.

11. The assembly of claim 10, wherein said body includes at least one fastener engaging at least one leg on said sleeve for coupling said sleeve to said body.

12. An electrical connector assembly comprising:

a hollow body having an open outer end, said body being made from an electrically insulting material and having an internal cavity supporting an electrical wiring device, said electrical wiring device having a coupling end positioned at an outer distal end of said body; and a metal sleeve surrounding at least a portion of said body and coupled to said body, said sleeve having a substantially cylindrical outer surface with coupling threads on said outer surface for mating with a threaded coupling of another electrical wiring device, and said sleeve being electrically insulated from said electrical wiring device by said body.

13. The assembly of claim 12, wherein said body has a collar defining said open outer end of said body and where said sleeve has a substantially cylindrical shape with an inner dimension complementing an outer dimension of said collar and where an outer end of said sleeve is aligned with an outer end of said collar.

14. The assembly of claim 12, wherein said body includes a coupling assembly for coupling with said sleeve and where said sleeve is coupled to said body by axial and rotational movement of said sleeve with respect to said body.

15. The assembly of claim 12, wherein said electrical wiring device is an electrical receptacle.

16. The assembly of claim 12, wherein said body includes a housing and where said housing has a base for coupling with a support surface.

17. The assembly of claim 16, wherein said base includes a plurality of holes having a dimension for receiving screws for coupling said body to said support surface.

18. An electrical connector assembly comprising:

a hollow body having an open outer end, said body being made from an electrically insulting material and having an internal cavity supporting an electrical wiring device, said electrical wiring device having a coupling end positioned at an outer distal end of a collar; and a metal sleeve surrounding at least a portion of said body and coupled to said body, said sleeve having a substantially cylindrical outer surface with coupling threads for mating with a threaded coupling, and said sleeve being electrically insulated from said electrical wiring device by said body, wherein said sleeve has a base with a plurality of legs extending from said base and coupled to said body.

19. The assembly of claim 18, wherein said body has a radially extending flange with a plurality of openings, each of said openings being positioned to receive a respective leg of said sleeve in a coupling engagement.

20. The assembly of claim 19, wherein each of said legs have a lug and where said openings have a dimension to receive said lug in a coupling engagement.

21. The assembly of claim 20, wherein said lugs extend radially outward with respect to an axis of said sleeve and where said openings in said body have an elongated slot shape with a first portion dimensioned to receive said lug and a second portion dimensioned to receive said leg and retain said lug in coupling engagement.

22. The assembly of claim 21, wherein said assembly includes a plurality of screws engaging said legs and securing said legs to said body.

23. An electrical assembly comprising:

a body made from an electrically insulating material, said body having a housing and a substantially cylindrical collar extending from said housing, said body having an internal cavity;

a first electrical wiring device mounted in said body and having a coupling end aligned with said collar where said coupling end is accessible through said collar, a metal sleeve having an inner dimension complementing an outer dimension of said collar, said sleeve having an outer surface with a coupling member, and where said sleeve is mounted on and coupled to said body and surrounding said collar, said metal sleeve being mounted on said body to resist rotation of said metal sleeve on said collar and being electrically insulated from said first electrical wiring device by said collar; and a second mating electrical wiring device separably coupled to said first electrical wiring device through said collar and having a coupling member separably coupled to said coupling member of said sleeve.

24. The assembly of claim 23, wherein said coupling member on said sleeve comprises external threads and where said coupling member on said second electrical device comprises a collar having internal threads complementing said threads on said sleeve.

25. The assembly of claim 23, wherein said sleeve has a plurality of legs extending from a proximal end for coupling said sleeve to said body.

26. The assembly of claim 25, wherein said housing includes a plurality of openings for receiving a respective leg of said sleeve.

27. The assembly of claim 26, wherein said openings are slots facing an axial direction with respect to a longitudinal axis of said housing.

28. The assembly of claim 26 wherein said housing includes a radially extending flange and where said openings define slots in said flange.

29. The assembly of claim 27, wherein each of said legs have a lug with a perimeter greater than a perimeter of said legs, and where said slots have a first portion dimensioned to allow said lug to pass through and a second portion dimensioned to receive a respective leg to capture said lug.

30. The assembly of claim 29, wherein said sleeve is coupled to said housing by axial and rotational movement of said sleeve with respect to said housing.

31. The assembly of claim 23, wherein said housing includes a base for coupling with a support surface.

32. The assembly of claim 23, wherein said first electrical wiring device is an electrical receptacle and where said second electrical wiring device is an electrical plug.

33. An electrical connector assembly comprising:

a body having an internal cavity supporting a first electrical device, an annular collar having a distal end and an opening in said distal end of said annular collar for allowing access to said first electrical device, and where said body is made from a non-metallic, electrically insulating material; and an annular metal sleeve having a distal end and a proximal end and being coupled to said body and surrounding at least a portion of said annular collar whereby said metal sleeve is electrically insulated from said first electrical device by said annular collar and surrounds said opening in said body, said metal sleeve having an outer surface with a coupling member for removably coupling to a second mating electrical connector.

34. The assembly of claim 33, wherein said metal sleeve has at least one leg extending axially from said proximal end of said sleeve, said at least one leg being coupled to said body.

35. The assembly of claim 33, wherein said outer surface of said annular metal sleeve has external threads defining said coupling member for coupling said first electrical device to a second electrical device.

36. The assembly of claim 33, wherein said sleeve is coupled to said body to resist rotation of said sleeve with respect to said body.

37. The assembly of claim 34, wherein said body includes at least one hole positioned to receive said at least one leg and where said at least one leg is received in said hole to couple said sleeve to said body.

38. The assembly of claim 37, wherein said at least one hole is axially aligned with said opening in said body.

39. The assembly of claim 33, wherein said sleeve includes a plurality of legs extending axially from said proximal end of said sleeve, and wherein said body includes a plurality of holes to receive a respective leg of said sleeve to couple said sleeve to said body.

40. The assembly of claim 33, further comprising a fastener to fasten said annular metal sleeve to said body.

41. The assembly of claim 40, wherein said fastener is a screw.

42. An electrical connector assembly comprising:

a body supporting a first electrical writing device therein, said body having an annular collar with an open end defining an access opening to said electrical wiring device, said body being made of a plastic electrically insulating material; and an annular metal sleeve encircling said collar of said body and mounted on said collar to resist rotation of said sleeve on said collar, said sleeve having a coupling member for connecting said first electrical wiring device to a second electrical wiring device.

43. The assembly of claim 42, wherein said coupling member is external threads formed on an outer surface of said sleeve.

44. The assembly of claim 42, further comprising a fastener to fasten said sleeve to said body.

45. The assembly of claim 42, wherein said sleeve includes at least one leg extending axially from a proximal end of said sleeve, and where said body includes at least one hole receiving said at least one leg to couple said sleeve to said body.

46. The assembly of claim 42, wherein said sleeve includes a plurality of legs extending axially from said sleeve, and where said body includes a plurality of holes receiving a respective leg of said sleeve to couple said sleeve to said body.

47. The assembly of claim 45, wherein each of said legs have a lug extending outwardly in a direction substantially perpendicular to a longitudinal axis of said leg, and where each of said holes have a substantially key-hole shape to receive a respective leg and couple said sleeve to said body.

* * * * *